US009321084B2

(12) United States Patent
Karube

(10) Patent No.: US 9,321,084 B2
(45) Date of Patent: Apr. 26, 2016

(54) DESCALING NOZZLE FOR REMOVING SCALE FROM STEEL SHEET, DESCALING APPARATUS FOR REMOVING SCALE FROM STEEL SHEET, AND DESCALING METHOD FOR REMOVING SCALE FROM STEEL SHEET

(75) Inventor: Kenta Karube, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 279 days.

(21) Appl. No.: 13/994,110

(22) PCT Filed: Dec. 13, 2011

(86) PCT No.: PCT/JP2011/079271

§ 371 (c)(1),
(2), (4) Date: Jul. 10, 2013

(87) PCT Pub. No.: WO2012/081716

PCT Pub. Date: Jun. 21, 2012

(65) Prior Publication Data

US 2013/0277445 A1 Oct. 24, 2013

(30) Foreign Application Priority Data

Dec. 14, 2010 (JP) ..... 2010-278435
Dec. 5, 2011 (JP) ..... 2011-266195

(51) Int. Cl.

| | |
|---|---|
| ***B05B 1/34*** | (2006.01) |
| ***B08B 3/02*** | (2006.01) |
| ***B05B 1/04*** | (2006.01) |
| ***B21B 45/08*** | (2006.01) |

(52) U.S. Cl.

CPC ..... *B08B 3/022* (2013.01); *B05B 1/042* (2013.01); *B21B 45/08* (2013.01); *B05B 1/34* (2013.01); *Y10T 29/49323* (2015.01); *Y10T 29/49432* (2015.01)

(58) Field of Classification Search

CPC ..... Y10T 29/49323; Y10T 29/49432; Y10T 29/49517; Y10T 29/49279; Y10T 29/49991

See application file for complete search history.

(56) References Cited

U.S. PATENT DOCUMENTS

| | | | | |
|---|---|---|---|---|
| 7,181,943 | B2 * | 2/2007 | Seidel | 72/39 |
| 7,367,518 | B2 | 5/2008 | Tanigaki et al. | |
| 2007/0125882 | A1 * | 6/2007 | Schwal et al. | 239/434 |

FOREIGN PATENT DOCUMENTS

| | | | |
|---|---|---|---|
| JP | 58001167 | B2 | 1/1983 |
| JP | 60015684 | B2 | 4/1985 |

(Continued)

OTHER PUBLICATIONS

International Search Report (ISR) dated Jan. 17, 2012 issued in International Application No. PCT/JP2011/079271.

*Primary Examiner* — Jason L Vaughan
*Assistant Examiner* — Amanda Meneghini
(74) *Attorney, Agent, or Firm* — Holtz, Holtz & Volek PC

(57) ABSTRACT

A descaling nozzle that can efficiently remove scale from a steel sheet. A spray section at an end of the descaling nozzle includes a taper portion continuous with a large diameter portion that forms a cylindrical channel, a first orifice formed on an outlet side of the taper portion, a resonant chamber continuous with an outlet side of the first orifice and that has a dimension in a radial direction that is greater than a major axis of the first orifice, and a second orifice formed on an outlet side of the resonant chamber.

7 Claims, 5 Drawing Sheets

(56) References Cited

FOREIGN PATENT DOCUMENTS

| | | | |
|---|---|---|---|
| JP | 1249214 | A | 10/1989 |
| JP | 05317815 | A | 12/1993 |
| JP | 08257998 | A | 10/1996 |
| JP | 3129967 | B2 | 1/2001 |
| JP | 2001062410 | A | 3/2001 |
| JP | 2005034908 | A | 2/2005 |
| JP | 4084295 | B2 | 4/2008 |
| KR | 1020070076138 | A | 7/2007 |
| WO | 2004058427 | A1 | 7/2004 |

* cited by examiner

DESCALING NOZZLE FOR REMOVING SCALE FROM STEEL SHEET, DESCALING APPARATUS FOR REMOVING SCALE FROM STEEL SHEET, AND DESCALING METHOD FOR REMOVING SCALE FROM STEEL SHEET

TECHNICAL FIELD

The present invention relates to a descaling nozzle for removing scale from a surface of a steel sheet, a descaling apparatus for removing scale from a steel sheet, and a descaling method for removing scale from a steel sheet.

BACKGROUND ART

In a rolling line for rolling a steel material, a steel material is charged into a heating furnace in an oxidizing atmosphere, is heated for several hours at a temperature generally in the range of 1100 to 1300° C., and subsequently is hot rolled. When hot rolling is performed, primary scale is generated during heating and secondary scale is generated after discharging from the heating furnace. If rolling of a steel material is performed without removing such scale, the scale becomes buried in the surface of the steel sheet, which is a product, and causes scale defects. Scale defects greatly influence the product quality, because scale defects significantly impair the surface condition of a steel sheet and become the initiation of cracks during bending work.

To solve the problem, the following methods have been proposed: (1) a method of applying an antioxidant agent to a surface of a steel material (see, for example, Patent Literature 1), (2) a method of heating a steel material at a temperature equal to or lower than the melting point of fayalite (about 1170° C.) (see, for example, Patent Literature 2), (3) a method of performing rolling in a completely oxygen-free state (see, for example, Patent Literature 3), (4) a method of making the temperature before rolling and temperature during rolling be high (about 1000° C. or higher), and (5) a method of completely removing generated scale (see, for example, Patent Literature 4).

However, with the method (1), not only it is necessary to additionally perform a troublesome application operation, but also the production cost is increased due to the cost of a processing agent. With the method (2), a load applied to the rolling mill increases, because a steel material is heated at a low temperature. Moreover, depending on the steel grade, the method may not be used in consideration of ensuring material characteristics. The method (3) is not realistic, because it requires high equipment cost. With the method (4), fuel consumption rate increases and scale loss increases, because discharging from the heating furnace is performed at a high temperature.

As a solution to the problem, the method (5) of completely removing generated scale, which is a method of performing so-called "descaling", is effective. A descaling nozzle used for a descaling apparatus for performing descaling usually sprays high pressure water onto a surface of a steel sheet and peels off and removes scale from the steel sheet using the impact force of the sprayed water.

CITATION LIST

Patent Literature

[PTL 1] Japanese Unexamined Patent Application Publication No. 1-249214

[PTL 2] Japanese Examined Patent Application Publication No. 58-1167

[PTL 3] Japanese Examined Patent Application Publication No. 60-15684

[PTL 4] Japanese Patent No. 4084295

[PTL 5] Japanese Patent No. 3129967

SUMMARY OF INVENTION

Technical Problem

Regarding the method (5), Patent Literature 4 describes a technology for improving the internal structure of a descaling nozzle. The descaling nozzle includes an orifice (discharge hole) at an end of the nozzle, a taper portion extending so as to be tapered with a taper angle of 30 to 80° from the orifice, and a large diameter portion connected to the taper portion. The ratio (D1/D2) of the inside diameter D1 of the large diameter portion to the minor axis D2 of the orifice is greater than or equal to 3.

However, the technology described in Patent Literature 4 has a limitation that it cannot significantly improve the descaling performance, because it is a technology for optimizing the internal structure of existing descaling nozzles.

The inventors focused on such a problem and carried out examinations using a descaling performance evaluation model that the inventors had previously proposed (see Patent Literature 5) in order to provide a descaling nozzle for removing scale from a steel sheet, a descaling apparatus for removing scale from a steel sheet, and a descaling method for removing scale from a steel sheet, with which scale can be more efficiently removed.

Descaling performance can be evaluated using a total impact force (F) and a unit impact force (S), which are generated when sprayed water impacts on a surface of a steel material. FIG. 1 illustrates an impact model representing the impact of water droplets on a steel sheet when descaling using sprayed water is performed. The total impact force (F) and the unit impact force (S) in FIG. 1 can be represented by the following equations:

$$F=P0\times a\times C\times(3/d)\times\alpha\times t, \text{ and}$$

$$S=F/A,$$

where "F" is the total impact force [N] of sprayed water at a surface of a steel sheet, "S" is the unit impact force [Pa] of sprayed water at the surface of the steel sheet, "P0" is the spraying pressure [Pa], "a" is the orifice area [$m^2$], "C" is the sonic speed [m/s], "d" is the droplet diameter of a water droplet [m], "α" is a coefficient, and "t" is the time during which a shock wave travels across the droplet [s].

Solution to Problem

The inventors carried out further examinations using the descaling performance evaluation model, and focused on the droplet diameter d [m]. The inventors discovered that the total impact force (F) and the unit impact force (S) can be increased and the descaling performance can be improved by making the droplet diameter be very small.

To solve the problem mentioned above, according to an aspect of the present invention, there is provided a descaling nozzle for removing scale from a steel sheet by spraying water onto a surface of the steel sheet and using impact of the water. A spray section at an end of the nozzle includes a taper portion that is continuous with a large diameter portion that forms a cylindrical channel, a first orifice that is formed on an outlet side of the taper portion, a resonant chamber that is continuous with an outlet side of the first orifice and that has a dimension in a radial direction that is greater than a major axis of the first orifice, and a second orifice formed on an outlet side of the resonant chamber.

Existing descaling nozzles generate a droplet stream by spraying a continuous jet from an orifice. However, with the descaling nozzle for removing scale from a steel sheet according to the aspect of the present invention, vibration that is generated in the shear layer around a sprayed jet and that has a specific frequency dependent on the volume of the resonant chamber is amplified, so that a periodic and intermittent (discontinuous) jet (or a pulse jet) is formed. Thus, formation of a droplet stream is accelerated, and thereby the droplet diameter can be made very small. Accordingly, the total impact force (F) and the unit impact force (S) generated when droplets impact on a surface of a steel material can be increased. As a result, the descaling nozzle has a descaling performance that is significantly higher than those of existing nozzles.

In the descaling nozzle for removing scale from a steel sheet according to the aspect of the present invention, although the resonant chamber may have any appropriate cross-sectional shape, it is preferable that the resonant chamber have a rectangular cross-sectional shape. This is because resonance and amplification of vibration can be efficiently performed by causing reflection perpendicularly to wall surfaces. In contrast, if the resonant chamber has curved wall surfaces, such as in a case where the resonant chamber has a circular cross-sectional shape, a flow becomes diffused and vibration is not likely to be amplified.

In the descaling nozzle for removing scale from a steel sheet according to the aspect of the present invention, it is preferable that the second orifice be elliptical, and the resonant chamber have a height in an axial direction that is in a range of 0.5 to 10 times a major axis of the second orifice.

To solve the problem mentioned above, according to an aspect of the present invention, there is provided descaling apparatus for removing scale from a steel sheet. The descaling apparatus includes a plurality of descaling nozzles disposed above and below the steel sheet that is a material to be rolled in a rolling process. The descaling apparatus removes scale from a surface of the material to be rolled by spraying high pressure water from the descaling nozzles onto the surface of the material to be rolled. Each of the descaling nozzles is the descaling nozzle for removing scale from a steel sheet according to any one of the embodiments of the aspect of the present invention described above.

With the descaling apparatus for removing scale from a steel sheet according to the aspect of the present invention, because each of the descaling nozzles has the effect and the advantage of the descaling nozzle according to one of the embodiments of the present invention described above, scale can be efficiently removed through the aforementioned mechanism.

To solve the problem mentioned above, according to an aspect of the present invention there is provided a method for removing scale from a steel sheet that is a material to be rolled in a rolling process by spraying high pressure water from a descaling nozzle onto a surface of the material to be rolled. The descaling nozzle for removing scale from a steel sheet according to any one of the embodiments of the aspect of the present invention described above is used as the descaling nozzle. The descaling nozzle is disposed at each of a plurality of positions above and below the rolling material in the rolling process. High pressure water is sprayed from the descaling nozzles onto the surface of the material to be rolled to remove scale from the surface of the material to be rolled.

With the descaling method for removing scale from a steel sheet according to the aspect of the present invention, because the descaling nozzle used in the method has the effect and the advantage of the descaling nozzle according to one of the embodiments of the present invention described above, scale can be efficiently removed through the aforementioned mechanism.

Advantageous Effects of Invention

As described above, with the present invention, scale can be efficiently removed from a surface of a material to be rolled.

DESCRIPTION OF EMBODIMENTS

Hereinafter, an embodiment of a descaling apparatus for removing scale from a steel sheet including a descaling nozzle according to an aspect of the present invention will be described.

Figure 1:
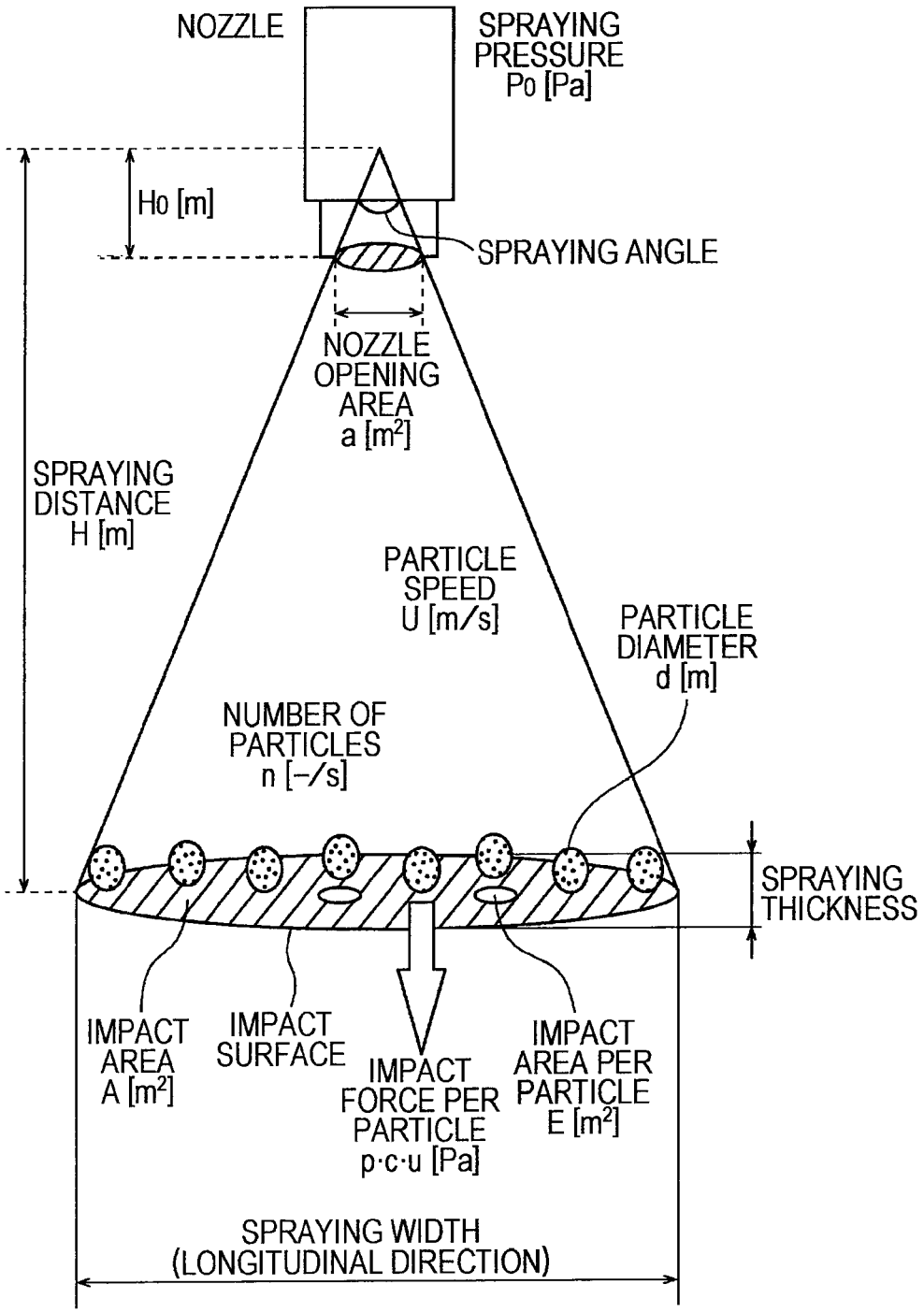
FIG. 1 illustrates an impact model representing the impact of water droplets on a steel sheet when descaling using sprayed water is performed.
Figure 2:
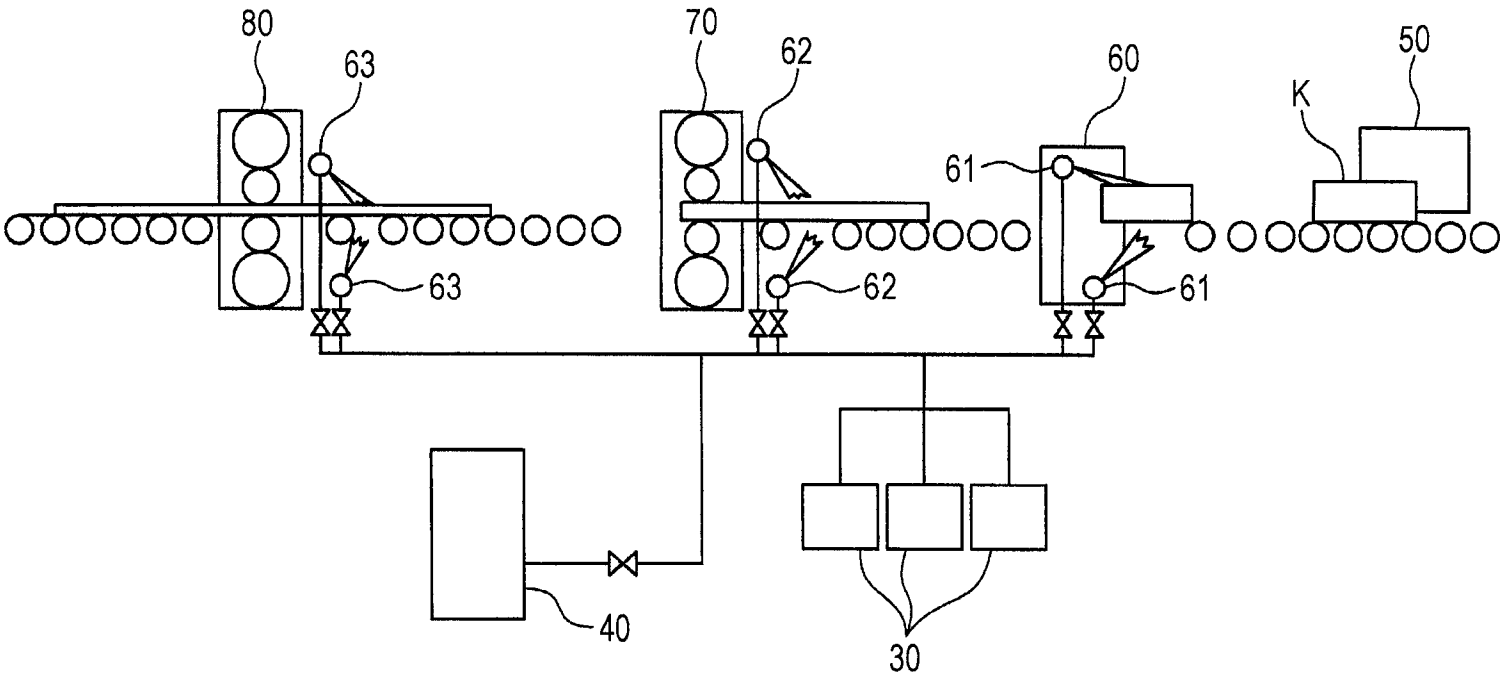
FIG. 2 is a schematic view illustrating an example of a rolling line including a descaling apparatus for removing scale from a steel sheet according to the present invention.

As illustrated in FIG. 2, a rolling line for rolling a steel sheet includes a heating furnace 50 that heats a material to be rolled (steel sheet) K, a heating furnace delivery side descaler 60 that is disposed on the delivery side (HSB) of the heating furnace 50 and that removes scale from the material to be rolled K that has been discharged from the heating furnace 50, a rough rolling mill 70 that subsequently performs rough rolling, and a finish rolling mill 80 that subsequently performs finish rolling.

The descaling apparatus according to the present invention is disposed in each section of the rolling line. That is, in the heating furnace delivery side descaler 60, descaling nozzle attachment adapters 61 for attaching heating furnace delivery side descaling nozzles are disposed above and below the material to be rolled K. Likewise, on the rough rolling entry side (RSB) of the rough rolling mill 70, descaling nozzle attachment adapters 62 are disposed above and below the material to be rolled K. On the finish rolling entry side (FSB) of the finish rolling mill 80, decaling nozzle attachment adapters 63 are disposed above and below the material to be rolled K. A descaling nozzle 1 described below (hereinafter, simply referred to as a "nozzle") is attached to each of the decaling nozzle attachment adapters 61, 62, and 63. The descaling nozzles 1 attached to the descaling nozzle attachment adapters 61, 62, and 63 are connected to pumps 30 and an accumulator 40 through pipes, and can spray high pressure water onto a surface of the material to be rolled K. The descaling apparatus includes the pumps 30 and the accumulator 40, so that the pressure and the amount of sprayed high-pressure water can be constantly and stably controlled.

Figure 3:
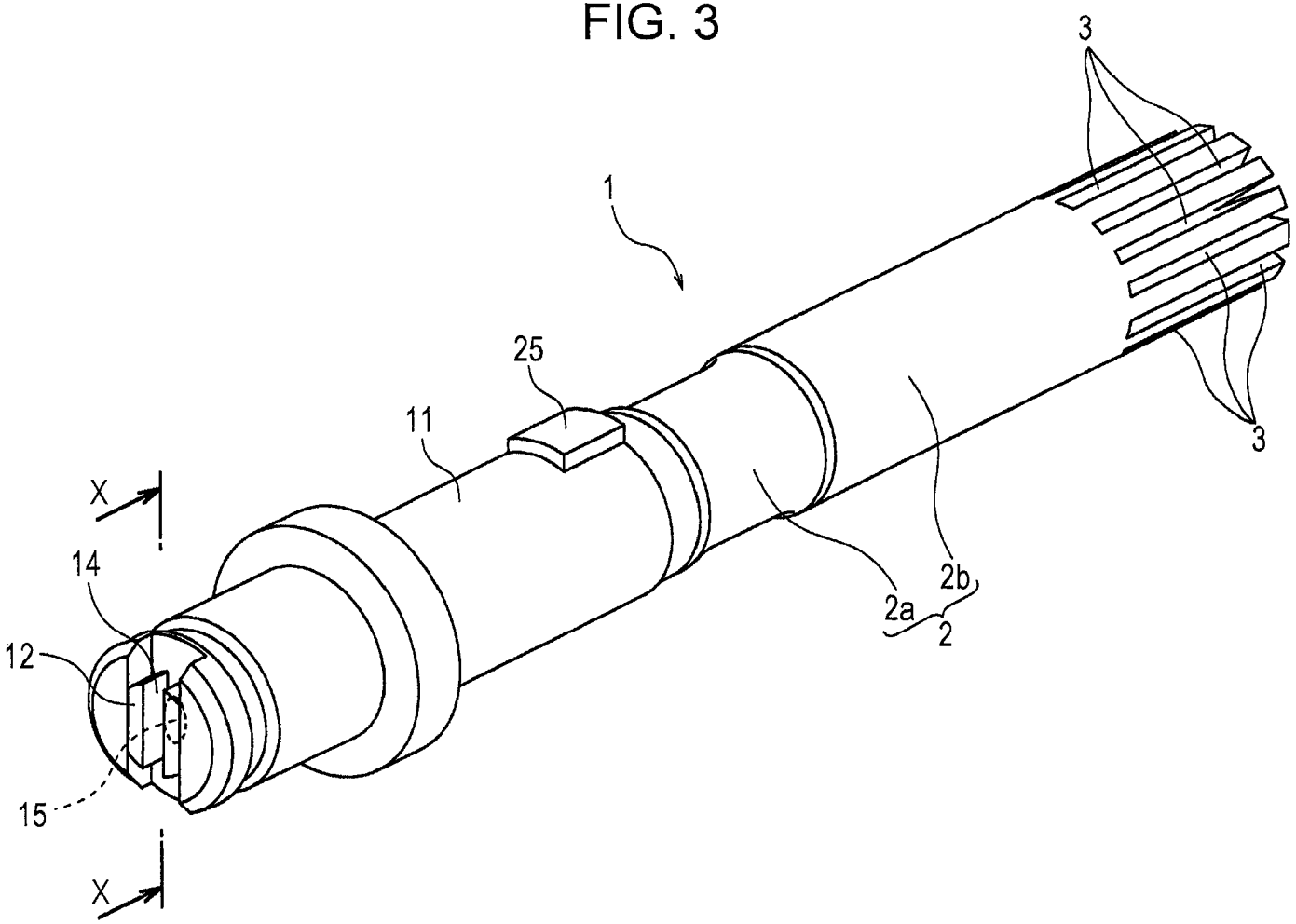
FIG. 3 is a schematic perspective view illustrating an example of a descaling nozzle according to the present invention.

Next, the nozzle 1 will be described in detail. FIG. 3 is a schematic perspective view of the nozzle 1, FIG. 4 is a schematic sectional view of FIG. 3 taken along line X-X, and FIG. 5 is a schematic front view of a spray section at an end of the nozzle of FIG. 3.

Figure 4:
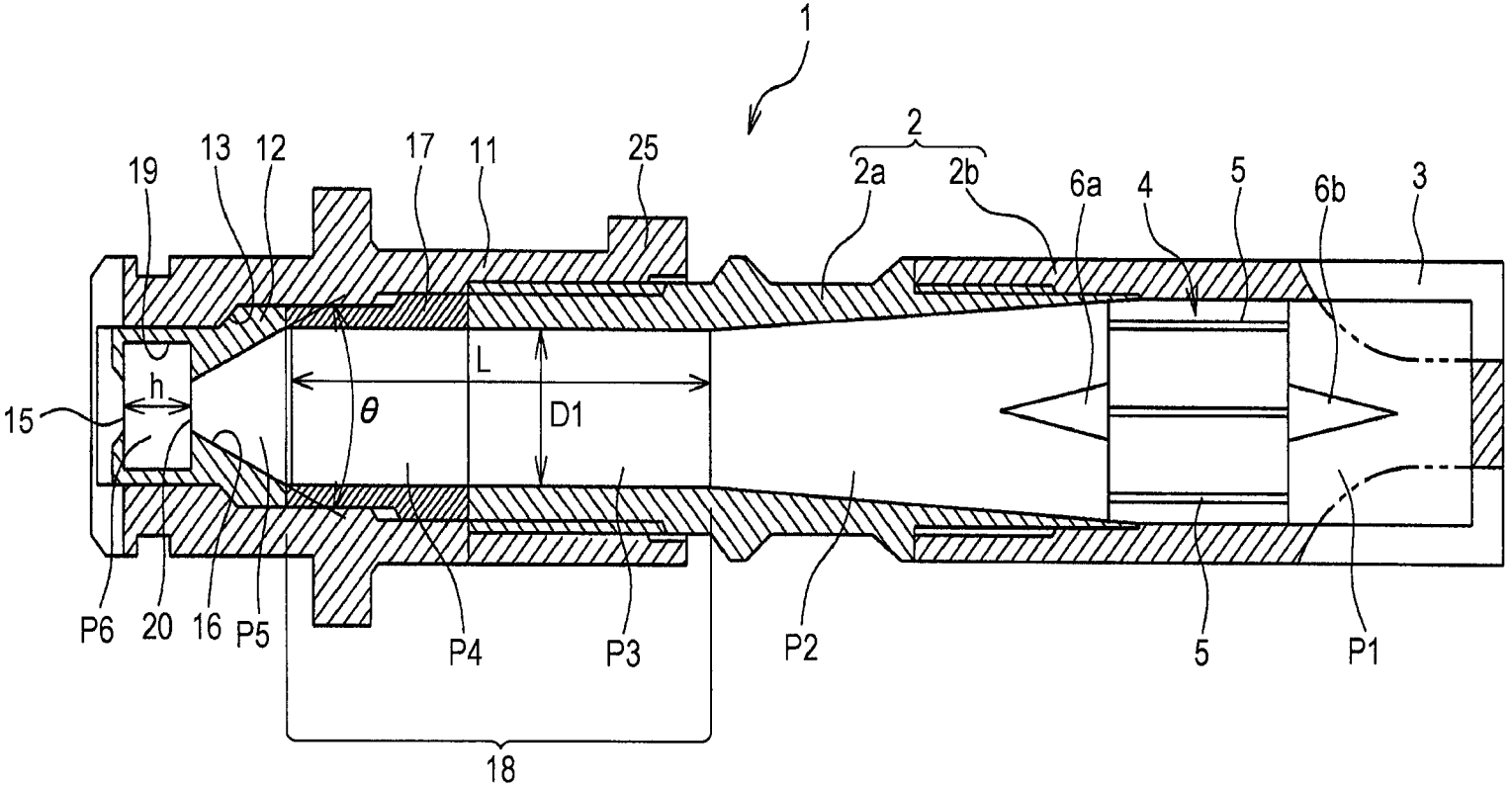
FIG. 4 is a schematic sectional view taken along line X-X of FIG. 3.
Figure 5:
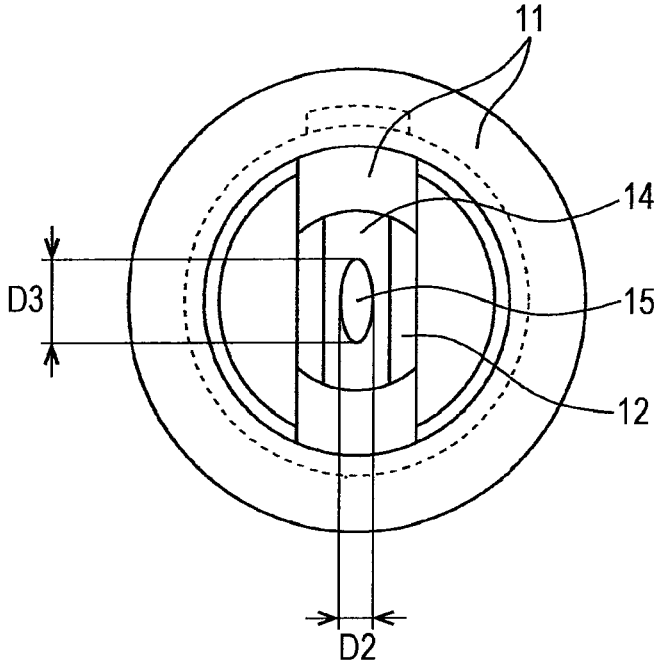
FIG. 5 is a schematic front view of a spray section of the nozzle of FIG. 3.

As illustrated in FIGS. 3 to 5, the nozzle 1 includes a casing 2, a nozzle case 11, and a nozzle tip 12. These members form a channel (or a nozzle hole) extending in the axial direction of the nozzle 1.

The casing 2 is substantially cylindrical and has a channel (or a nozzle hole) formed therein. Water can flow into the channel from one end of the casing 2 on the upstream side of the nozzle 1. The nozzle case 11 is attached to the other end of the casing 2. The nozzle case 11 is substantially cylindrical, and the nozzle tip 12 is attached to an end portion of the nozzle 1. The nozzle tip 12, from which water is sprayed, is made of a cemented carbide.

In this example, the casing 2 includes a first casing 2*a*, which can be fixed to the nozzle case 11 with a screw thread, and a second casing 2*b*, which can be fixed to the first casing 2*a* with a screw thread.

In a peripheral surface and an end surface of the upstream end portion of the second casing 2*b*, a plurality of slits (or inlets) 3 extending in the axial direction are arranged in the circumferential direction at a predetermined pitch. The slits 3 serve as a filter that allows entry of water while suppressing entry of impurities. A flow regulation unit (or a flow regulator or a stabilizer) 4 is disposed in a channel in the second casing 2*b*. The flow regulation unit 4, which guides water from the slits 3 to nozzle holes, includes a plurality of flow regulation plates (flow regulation blades) 5 extending radially from a core member, and a pair of pointed conical portions (respectively tapered upstream and downstream) 6*a* and 6*b*, which are formed on the upstream side and on the downstream side of the core member so as to be coaxial with each other and so that the end portions thereof respectively point upstream and downstream. The casing 2, which serves as a filter and includes the flow regulation unit, may be called a filter unit or a flow regulation casing.

The flow regulation plates 5 of the flow regulation unit 4 are in contact with an inner wall of the second casing 2*b*. Movement of the flow regulation unit 4 in the downstream direction is restricted by fixing means (for example, engaging, welding, or adhesion).

The channel in the casing 2 includes a cylindrical channel P1, an inclined channel (annular inclined channel) P2, and a cylindrical channel P3. The cylindrical channel P1 extends from an upstream end (inlet) of the second casing 2*b* to a downstream end of the flow regulation unit 4 and has a substantially constant inside diameter (which is the same as the inside diameter of the upstream end portion of the casing 2*b*). The inclined channel P2 extends downstream from the downstream end of the flow regulation unit 4 to a middle portion of the first casing 2*a* and tapers with a gentle inclination. The cylindrical channel P3 extends downstream from a downstream end of the inclined channel and has a substantially constant inside diameter (which is the same as the inside diameter of a downstream end portion of the inclined channel P2). In this example, the taper angle of inclined wall (taper portion) of the inclined channel (annular inclined channel) P2 is, for example, in the range of 5 to 10°.

The nozzle tip 12, which is made of a cemented carbide, and a bushing (or an annular side wall) 17 are attached to the inside of the nozzle case 11 so as to be arranged upstream from the end of the nozzle 1. In the bushing 17, a channel having an inside diameter substantially the same as that of the downstream end of the first casing 2*a* is formed. An engagement stepped portion 13 prevents the nozzle tip 12 from being extracted toward the end portion.

In the nozzle tip 12, which corresponds to a spray section at an end of the nozzle 1, includes a taper portion 16 that is continuous with a large diameter portion that forms a cylindrical channel, a first orifice 20 that is continuous with the outlet side of the taper portion 16, and a resonant chamber 19 that is continuous with the outlet side of the first orifice 20 and that has a dimension in the radial direction that is greater than the major axis of the first orifice 20. Because the resonant chamber 19 is a space formed by dividing the inside of the nozzle tip 12, the material of the resonant chamber 19 is made of a cemented carbide, which is the same as that of the nozzle tip 12.

Regarding the specific structure of the resonant chamber 19, it is preferable that the resonant chamber 19 have a rectangular cross-sectional shape, although the resonant chamber 19 may have a circular cross-sectional shape. This is because, when the resonant chamber 19 has a rectangular cross-sectional shape, resonance can be efficiently amplified by causing reflection perpendicularly to wall surfaces.

In an end surface of the nozzle tip 12, a curved groove 14 having a U-shaped cross section is formed so as to extend in the radial direction. As illustrated in FIG. 5, in a concavely curved surface of the curved groove 14, a discharge hole 15 having an elliptical shape is formed as a second orifice so as to be continuous with the outlet side of the resonant chamber. The bottom surface of the curved groove 14 may be a curved bottom surface whose end portions rise from the discharge hole 15, which is the bottommost portion, in an extension direction (or the radial direction).

Thus, a nozzle channel (nozzle hole), which extends in the axial direction of the nozzle 1, includes a resonant channel P6, a conical channel P5, a cylindrical channel P4, and the cylindrical large-diameter channels (channels extending from the upstream end of the cylindrical channel P4 to the upstream end of the flow regulation unit 4) P3 to P1. The resonant channel P6 includes the discharge hole (second orifice) 15 having an elliptical opening in the curved groove 14, the resonant chamber 19 formed in the nozzle tip 12 and having an rectangular pipe shape, and the first orifice 20 formed on the inlet side of the resonant chamber 19. The conical channel P5 includes the taper portion (or a conical inclined wall) 16 extending upstream from the first orifice 20 in the axial direction with increasing diameter. The cylindrical channel P4 is formed by the inner periphery of the bushing 17 and extends upstream from the upstream end of the taper portion 16 in the axial direction with a uniform inside diameter. The cylindrical large-diameter channels P3 to P1 extend from the upstream end of the cylindrical channel P4. A large diameter portion 18 includes a channel extending from the upstream end of the taper portion 16 with a uniform inside diameter (in this example, the cylindrical channels P3 and P4, which extend from the upstream end of the taper portion 16 to the downstream end of the gently inclined channel P2).

The first orifice 20 and the discharge hole 15, which are elliptical, each have a ratio of the major axis to the minor axis that is in the range of about 1.5 to 1.8. Regarding the relationship among the first orifice 20, the discharge hole 15, and the large diameter portion 18, in order to reduce the size of the nozzle, the ratio (D1/D2) of the inside diameter D1 of the large diameter portion 18 (the cylindrical channels P3 and P4, or the downstream end of the inclined channel P2 extending downward from the flow regulation unit) to the minor axis D2 of the first orifice 20 and the discharge hole 15 is set in the range of about 4.5 to 6.9. In order to increase the impact force even if sprayed water has a low pressure and/or a low flow rate, the angle (taper angle) θ of the taper portion 16 is set in the range of about 45 to 55°.

An attachment portion such as a brim portion (or a flange) for attaching the nozzle 1 to a conduit (not shown) using an adapter (not shown) can be formed at an appropriate position on the nozzle case 11 or the casing 2 (in this example, the nozzle case 2). A positioning protrusion 25 for positioning the nozzle case 11 relative to a conduit may be formed on the nozzle case 11 so that the positioning accuracy can be increased and water can be sprayed in a flat shape or a strip-like shape in a predetermined direction.

Next, the effects and advantages of the descaling apparatus for removing scale from a steel sheet described above, the descaling nozzle 1 attached to the descaling apparatus, and a descaling method for removing scale from a steel sheet using the nozzle 1 will be described.

The nozzle 1 is attached to each of the descaling nozzle attachment adapters 61, 62, and 63 of the descaling apparatus. The spray section at an end of the nozzle 1 includes the taper portion 16 that is continuous with the large diameter portion 18 that forms a cylindrical channel, the first orifice 20 that is formed on the outlet side of the taper portion 16, the resonant chamber 19 that is continuous with the outlet side of the first orifice 20 and that has a dimension in a radial direction that is greater than the major axis of the first orifice 20, and the discharge hole (second orifice) 15 formed on the outlet side of the resonant chamber 19. Therefore, vibration that is generated in the shear layer around a sprayed jet and that has a specific frequency dependent on the volume of the resonant chamber 19 is amplified, so that a periodic and intermittent (discontinuous) jet (or a pulse jet) is formed. Thus, formation of droplet flow is accelerated, and thereby the droplet diameter can be made very small. Accordingly, the total impact force (F) and the unit impact force (S) generated when droplets impact on a surface of a steel material can be increased. As a result, the descaling nozzle has a descaling performance that is significantly higher than those of existing nozzles. Accordingly, with the descaling apparatus, the descaling nozzle 1 attached to the descaling apparatus, and the descaling method for removing scale from a steel sheet using the nozzle 1, performance and efficiency in descaling can be significantly improved.

EXAMPLE

Figure 6:
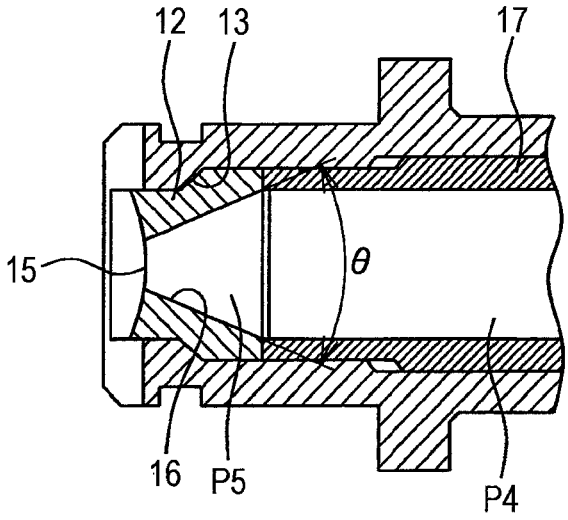
FIG. 6 illustrates a spray section of an existing descaling nozzle used in a comparative example.

Hereinafter, an example in which the nozzle 1 according to the embodiment was used in a descaling apparatus in an actual rolling line for rolling a material to be rolled K will be described. Steel materials used in the example had a standard width of 1.2 m and a standard thickness of 220 mm on the delivery side of the heating furnace 50, a standard thickness in the range of 220 to 70 mm on the rough rolling entry side (RSB) 62, and a standard thickness in the range of 60 to 40 mm on the finish rolling entry side (FSB) 63. Table 1 below shows the results of a comparative experiment in which comparison with an existing type of nozzle was performed (see FIG. 6). In this example, the height h of the resonant chamber 19 was adjusted so as to be in the range of 0.5 to 10 times the major axis D3 of the first and second orifices 15 and 19 in accordance with the spraying pressure P0 [Pa], the descaling flow rate [1/min], and the spraying distance H[m].

TABLE 1

| Evaluation Indices | | Values for Comparative Example | Values for Invention Example |
|---|---|---|---|
| Descaling Performance (Unit Impact Force S) | (1) HSB | 1.50 MPa | 2.25 MPa (1.5 times higher) |
| | (2) RSB | 0.26 MPa | 0.34 MPa (1.3 times higher) |
| | (3) FSB | 0.91 MPa | 1.18 MPa (1.3 times higher) |
| Descaling Flow Rate | (1) HSB | 111 l/min | 111 l/min |
| | (2) RSB | 66 l/min | 39 l/min |
| | (3) FSB | 66 l/min | 39 l/min |
| Electric Power Consumption Rate of Descaling Pump | | 1.0 | 0.7 |
| Index of Fraction Defective due to Decaling Performance | | 1.0 | less than 0.5 |

As shown in this table, in any section of the rolling line, the descaling performance was 1.3 to 1.5 times that of the comparative example, the electric power consumption rate of the pump 30 was 70%, a possible reduction margin of flow rate due to improvement in the descaling performance was 30%, and the fraction defective due to the descaling performance was less than 50% of the comparative example. Thus, with the descaling nozzle 1, the performance and efficiency in descaling was significantly improved.

According to the results of a comparative experiment using an existing type (see FIG. 6), it was confirmed that a sufficient effect can be obtained by making the height h of the resonant chamber 19 be adjusted to be in the range of 0.5 to 10 times the major axis D3 of the orifices 15 and 19 in accordance with the spraying pressure P0 [Pa], the descaling flow rate [1/min], and the spraying distance H [m].

A descaling nozzle for removing scale from a steel sheet, a descaling apparatus for removing scale from a steel sheet, and descaling method for removing scale from a steel sheet according to the present invention are not limited to the embodiments described above. The embodiments can be modified in various ways within the spirit and scope of the present invention.

REFERENCE SIGNS LIST

1 (descaling) nozzle
2 casing
4 flow regulation unit
11 nozzle case
12 nozzle tip

14 curved groove
15 discharge hole (second orifice)
16 taper portion (or conical inclined wall)
17 bushing (or annular side wall)
18 large diameter portion
19 resonant chamber
20 first orifice
30 pump
40 accumulator
50 heating furnace
60 heating furnace delivery side descaler
61, 62, 63 descaling nozzle attachment adapter
70 rough rolling mill
80 finish rolling mill
K material to be rolled (steel sheet)
P1 cylindrical channel
P2 inclined channel
P3 cylindrical channel
P4 cylindrical channel
P5 conical channel
P6 resonant channel

The invention claimed is:

1. A descaling nozzle for removing scale from a steel sheet by spraying water onto a surface of the steel sheet, the descaling nozzle comprising:

a spray section which is at an end of the descaling nozzle and which includes:

a taper portion that is continuous with a large diameter portion forming a cylindrical channel;

a first orifice that is formed on an outlet side of the taper portion; a resonant chamber that is continuous with an outlet side of the first orifice and that has a dimension in a radial direction that is greater than an outer diameter of the first orifice; and a second orifice formed on an outlet side of the resonant chamber, wherein the resonant chamber has a rectangular cross-sectional shape and has non-curved wall surfaces, wherein all of the non-curved wall surfaces of the resonant chamber are flat.

2. The descaling nozzle for removing scale from a steel sheet according to claim 1, wherein the second orifice is elliptical, and the resonant chamber has a height in an axial direction that is in a range of 0.5 to 10 times an outer diameter of the second orifice.

3. The descaling nozzle for removing scale from a steel sheet according to claim 1, wherein the spray section further includes a nozzle tip, and wherein the taper portion, the first orifice, the resonant chamber, and the second orifice are integrally formed in the nozzle tip.

4. A descaling apparatus for removing scale from a steel sheet, the descaling apparatus comprising a plurality of descaling nozzles that include:

a spray section which is at an end of the descaling nozzles and which includes:

a taper portion that is continuous with a large diameter portion forming a cylindrical channel;

a first orifice that is formed on an outlet side of the taper portion; a resonant chamber that is continuous with an outlet side of the first orifice and that has a dimension in a radial direction that is greater than an outer diameter of the first orifice; and a second orifice formed on an outlet side of the resonant chamber, wherein the resonant chamber has a rectangular cross-sectional shape and has non-curved wall surfaces, wherein all of the non-curved wall surfaces of the resonant chamber are flat;

the descaling nozzles are disposed above and below the steel sheet that is a material to be rolled in a rolling process, the descaling apparatus removing scale from a surface of the material to be rolled by spraying high pressure water from the descaling nozzles onto the surface of the material to be rolled.

5. A method for removing scale from a steel sheet that is a material to be rolled in a rolling process by spraying high pressure water from a descaling nozzle onto a surface of the material to be rolled, wherein the descaling nozzle includes:

a spray section which is at an end of the descaling nozzle and which includes:

a taper portion that is continuous with a large diameter portion forming a cylindrical channel;

a first orifice that is formed on an outlet side of the taper portion; a resonant chamber that is continuous with an outlet side of the first orifice and that has a dimension in a radial direction that is greater than an outer diameter of the first orifice; and a second orifice formed on an outlet side of the resonant chamber, wherein the resonant chamber has a rectangular cross-sectional shape and has non-curved wall surfaces, wherein all of the non-curved wall surfaces of the resonant chamber are flat;

said descaling nozzle is disposed at each of a plurality of positions above and below the rolling material in the rolling process, and high pressure water is sprayed from the descaling nozzles onto the surface of the material to be rolled to remove scale from the surface of the material to be rolled.

6. A descaling apparatus for removing scale from a steel sheet, the descaling apparatus comprising a plurality of descaling nozzles that include:

a spray section which is at an end of the descaling nozzle and which includes:

a taper portion that is continuous with a large diameter portion forming a cylindrical channel;

a first orifice that is formed on an outlet side of the taper portion; a resonant chamber that is continuous with an outlet side of the first orifice and that has a dimension in a radial direction that is greater than an outer diameter of the first orifice; and a second orifice formed on an outlet side of the resonant chamber wherein the second orifice is elliptical, and the resonant chamber has a height in an axial direction that is in a range of 0.5 to 10 times an outer diameter of the second orifice, and wherein the resonant chamber has a rectangular cross-sectional shape and has non-curved wall surfaces, wherein all of the non-curved wall surfaces of the resonant chamber are flat;

the descaling nozzles are disposed above and below the steel sheet that is a material to be rolled in a rolling process, the descaling apparatus removing scale from a surface of the material to be rolled by spraying high pressure water from the descaling nozzles onto the surface of the material to be rolled.

7. A method for removing scale from a steel sheet that is a material to be rolled in a rolling process by spraying high pressure water from a descaling nozzle onto a surface of the material to be rolled, wherein the descaling nozzle includes:

a spray section which is at an end of the descaling nozzle and which includes:

a taper portion that is continuous with a large diameter portion forming a cylindrical channel;

a first orifice that is formed on an outlet side of the taper portion; a resonant chamber that is continuous with an outlet side of the first orifice and that has a dimension in a radial direction that is greater than an outer diameter of the first orifice; and a second orifice formed on an outlet side of the resonant chamber, and wherein the second orifice is elliptical, and the resonant chamber has a height in an axial direction that is in a range of 0.5 to 10 times an outer diameter of the second orifice, and the resonant chamber has a rectangular cross-sectional shape and has non-curved wall surfaces, wherein all of the non-curved wall surfaces of the resonant chamber are flat; the descaling nozzle is disposed at each of a plurality of positions above and below the rolling material in the rolling process, and high pressure water is sprayed from the descaling nozzles onto the surface of the material to be rolled to remove scale from the surface of the material to be rolled.

* * * * *